United States Patent [19]

McClellan et al.

[11] Patent Number: 4,542,041

[45] Date of Patent: Sep. 17, 1985

[54] APPARATUS FOR COATING PARTICULATE MATERIAL

[75] Inventors: Thomas R. McClellan, Seabrook; Pat L. Murray, Baytown, both of Tex.

[73] Assignee: The Upjohn Company, Kalamazoo, Mich.

[21] Appl. No.: 593,786

[22] Filed: Mar. 27, 1984

Related U.S. Application Data

[62] Division of Ser. No. 466,940, Feb. 16, 1983, Pat. No. 4,516,524.

[51] Int. Cl.[4] ..... B05D 7/00

[52] U.S. Cl. ..... 427/212; 118/19; 118/56; 118/303; 427/242; 427/420; 427/424

[58] Field of Search ..... 118/303, 56, 19; 427/242, 212, 420, 424

[56] References Cited

U.S. PATENT DOCUMENTS

| | | | |
|---|---|---|---|
| 2,658,847 | 11/1953 | MacDonald | 427/212 |
| 3,013,525 | 12/1961 | Fuller et al. | 118/303 |
| 3,104,424 | 9/1963 | Immel | 118/303 |
| 3,118,459 | 1/1964 | Stumpf | 118/303 |
| 3,198,655 | 8/1965 | Gisiger | 427/212 |
| 3,447,950 | 6/1969 | Evans et al. | 118/303 |
| 3,796,412 | 3/1974 | Maurer | 118/303 |
| 3,796,529 | 3/1974 | Greten | 425/224 |
| 3,938,469 | 2/1976 | Nau | 118/303 |
| 3,967,005 | 6/1976 | Cattaneo | 118/303 |
| 4,320,715 | 3/1982 | Maloney et al. | 118/303 |
| 4,360,545 | 11/1982 | Maloney | 427/212 |
| 4,370,945 | 2/1983 | Beckschulte et al. | 118/303 |
| 4,444,810 | 4/1984 | Huttlin | 427/212 |

*Primary Examiner*—Norman Morgenstern
*Assistant Examiner*—Janyce P. Bell
*Attorney, Agent, or Firm*—James S. Rose; Denis A. Firth

[57] ABSTRACT

An apparatus is disclosed for the continuous dispensing and blending of a fluid material with a particulate material in predetermined quantities. A master control is provided for synchronizing the startup and interruption of the systems for furnishing the particulate material and the fluid material and for operation of the blending apparatus, thereby facilitating the continuous operation thereof. The system is particularly adapted for use in the coating of wood furnish with binder adhesive prior to the pressing and heating of the wood furnish to form particle boards and the like.

8 Claims, 5 Drawing Figures

APPARATUS FOR COATING PARTICULATE MATERIAL

This application is a division of pending application Ser. No. 466,940 filed Feb. 6, 1983 now U.S. Pat. No. 4,516,524 May 14, 1985.

BACKGROUND OF THE INVENTION

1. Field of the Invention

This invention relates to apparatus for the blending of fluid material and particulate material and is more particularly concerned with systems for feeding fluid material and particulate material to blender means in a continuous operation.

2. Description of the Prior Art

Particle boards, and other composites derived by binding together particulate material using an adhesive binder, are prepared by coating the particulate material with the adhesive binder and forming the coated particles into a mat which is then subjected to the action of heat and pressure in order to prepare the final composite. In commercial production processes the coating of the particles, the formation of the mat, and the pressing operation are carried out in a substantially continuous manner; see, for example, U.S. Pat. Nos. 3,796,529 and 4,320,715. Illustratively, the particulate material and the binder are brought together and blended using Various types of mechanical blender and then passed to a storage bin or the like. From the latter the coated particles are dispensed on to a moving belt to form a mat which is subsequently conducted on the moving belt through a zone in which the mat is subjected to heat and pressure to form the particle board.

The adhesive used to prepare particle boards has hitherto commonly been a phenol-formaldehyde resin, but, more recently, polyisocyanates, particularly polymethylene polyphenyl polyisocyanates, have been used as the adhesive binder. Various methods of mechanically blending the particulate material and the binder have been described and employed in the art. Since the cost of the binder is a significant proportion of the total cost of the raw materials in production of the particle boards, it is desirable that the mixing of the binder and the particulate material be carried out as efficiently as possible without any significant loss of binder in the process. Centrifugal blenders have been employed in which the binder is dispensed through rotating radial dispensing arms in a housing through which the particulate material is being fed. U.S. Pat. No. 4,320,715 discusses this type of centrifugal blender and notes certain drawbacks. The patent describes a different form of blending in which the particles are caused to fall downwardly on the periphery of a blender vessel with a spray of fluid coating material being directed outwardly against the falling furnish by use of a series of rotating inverted conical atomizer disks.

The above types of systems appear to be reasonably satisfactory when phenol-formaldehyde is employed as the binder resin. However, in the case of the polyisocyanate binders, the quantity of binder being applied to the particulate material is significantly less and cannot be easily dispensed in a uniform manner using the above types of operation. Further, in a particular method of employing polyisocyanates as the binder resin, the polyisocyanate is emulsified in water and the emulsion is applied to the particulate material. Such emulsions of polyisocyanate have only a limited stability and, if prepared and stored prior to a production run, can be rendered useless or unsatisfactory if any breakdown of the production line occurs involving long delays which extend beyond the useful life of the emulsion.

When using polyisocyanates as the binder in coating particulate material, particularly for particle boards, it is highly desirable that the coating operation can be interrupted at any given moment in order to accommodate shutdowns of the production line in which the coated particles are being converted to finished boards. The previous types of blender used with phenol-formaldehyde resin binders are not readily adapted to such interruption in operation. Further, it is desirable, when using the polyisocyanate in the form of an aqueous emulsion, to provide systems which do not require production and storage of the emulsion in a preliminary step, but which permit the emulsion to be formed in situ at the time of dispensing and blending with the particulate material.

It is an object of the present invention to provide systems which meet these requirements. It is a further object of this invention to facilitate operations which utilize polyisocyanate as the binder either in neat form or in the form of an aqueous emulsion. Other advantages which are provided by the systems described below will be apparent to one skilled in the art.

SUMMARY OF THE INVENTION

This invention comprises apparatus for continuously coating particulate material with a fluid material which apparatus comprises:

- blender means comprising a substantially cylindrical housing having an inlet port and an exit port;
- agitator means mounted within said housing and adapted to provide mixing and propulsion of particulate material through said blender;
- means for feeding particulate material at a predetermined rate to the inlet port of said blender;
- means for feeding fluid coating material at a predetermined rate to the inlet port of said blender;
- means for transporting coated particulate material from said exit port of said blender to storage means; and
- control means for synchronously actuating and deactuating said agitator means and said means for feeding particulate material and fluid coating material to said blender.

The invention also comprises means for feeding the fluid coating material to the blender.

The invention also comprises means for feeding two or more components, required for preparation of a fluid coating material, in predetermined proportions to a mixing head from which the resulting fluid coating material is dispensed to the inlet port of the blender and mixed with the particulate material.

DETAILED DESCRIPTION OF THE INVENTION

Figures 1, 2:
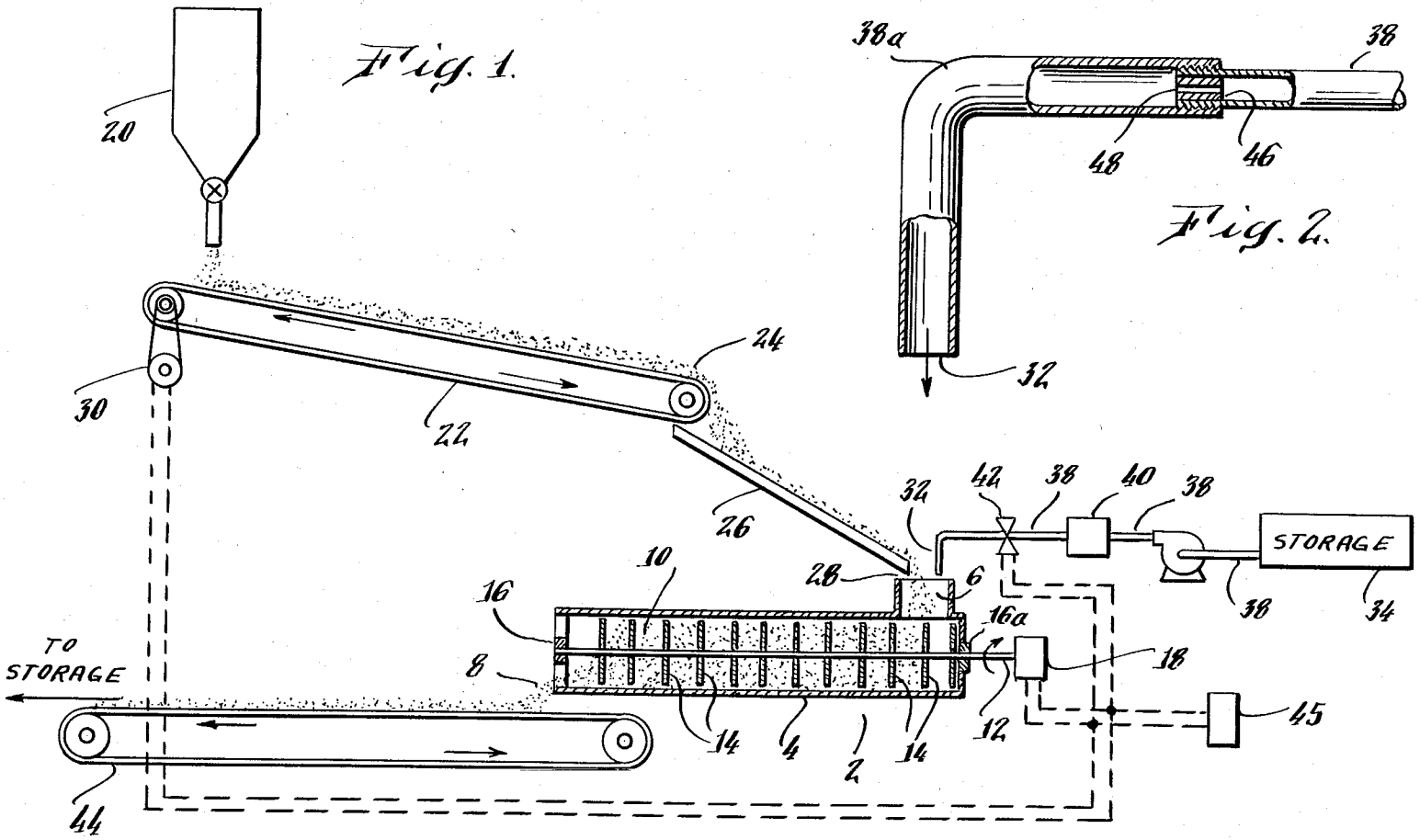
FIG. 1 shows, partly in schematic form and partly in cross-section, an embodiment of an apparatus in accordance with the invention.
FIG. 2 shows a cross-sectional view of a modification of the fluid material dispensing orifice shown in FIG. 1.

The apparatus of the invention and its mode of operation will be illustrated by reference to the particular embodiments set forth in the drawings, it being understood that these embodiments are merely exemplary and are not to be regarded as limiting the scope of the invention.

In the particular embodiment shown schematically in FIG. 1, a blender (2) is shown with a substantially cylindrical housing (4) provided with an inlet port (6) and an exit port (8). An agitator (10) is disposed within said housing (4) and is provided with a series of paddle members (14) disposed along the axis (12) thereof and mounted by means of bearings (16) and (16*a*) for rotation about its axis. Said agitator is rotated by means of variable speed motor (18). The actual shape and pitch of the plurality of paddle members (14) can be varied in accordance with the relative positions of said paddle members along the axis (12) of the agitator. The paddle members (14) which are adjacent to the inlet port (6) are preferably so shaped and pitched as to facilitate the propulsion of material being fed through the inlet port towards the exit port of the blender (2). Those paddle members (14) which are closest to the exit port (8) of the blender are so shaped and pitched that they tend to retard the progress of particulate material through the blender providing some holdup and increasing the efficiency with which the particular material can be blended with the fluid coating material.

The blender (2) is provided optionally with baffle members which project inwardly from the interior of the housing (4) into one or more of the spaces between the adjacent paddle members (14). Particulate material, illustratively wood furnish, is charged to the inlet port (6) of the blender (2) by feeding from a storage container (20), which can take any appropriate form, to a continuously travelling belt (22) which transports said particulate material and deposits same on to a chute (26) inclined to the horizontal and having its lower end (28) disposed above the inlet port (6). The continuous belt (22) is controlled by drive means (30) which can be an electrically actuated drive mechanism or any other suitable such mechanism.

Fluid coating material is introduced through inlet port (6) via orifice (32) to which said fluid material is fed from storage tank (34) by means of constant delivery pump (36) through appropriate conduits (38). In an optional embodiment the orifice (32) is provided with a spray jet of appropriate design to dispense said fluid material in any desired spray pattern. Fluid pressure regulator (40) serves to maintain the pressure and rate of flow of the fluid material at any desired level. Shutoff valve (42) controls the flow of fluid material to the orifice (32).

The shutoff valve (42), the agitator motor (18) and the drive means (30) for the continuous belt feed for the particulate material are all operatively connected for simultaneous actuation or deactuation to master control means (45). Thus, the startup of flow of the fluid material and of the particulate material to the blender, as well as operation of the agitator in the blender, can be accomplished simultaneously by operation of master control means (45). Similarly, the three different operations can be terminated simultaneously by operation of master control means (45).

The respective rates of flow of the particulate material and the fluid coating material can be adjusted and maintained in any particular desired relationship by suitable adjustment of the rate of feed of the particulate material and by rate of flow of the fluid coating material. The control of the former rate can be accomplished by adjusting the rate of operation of the continuous belt (22). The rate of dispensing of the fluid coating material from orifice (32) can be controlled by adjustment of the pressure maintained by the pressure regulator (40).

The blend of particulate material and coating material exiting from the blender (2) via exit port (8) is removed by a continuous conveyor belt (44) to a storage container [not shown]from which the coated material can be supplied on demand to the continuous forming operation to produce particle board.

In operation of the apparatus shown in FIG. 1 the particulate material and the fluid coating material each enter the blender (2) in predetermined ratio of proportions and are therein mixed and conveyed by means of the agitator (12) with paddles (14). It is found that the arrangement shown in FIG. 1 produces uniform distribution of the fluid material in the particulate material and gives rise to an homogeneous blended material which emerges from the exit port (8) of the blender (4). The operation can be interrupted at any time by operation of the master control means (45). The latter can take any appropriate form. Illustratively, it can provide an electrical impulse which closes or opens appropriate switches on electrically controlled drive mechanisms (18) and (30) and, at the same time, operates a solenoid or like device which controls the opening or closing of the shutoff valve (42). The apparatus therefore provides a very convenient mode of controlling the blending operation both as to the maintenance of appropriate ratios of the particulate material and fluid coating material and also enables the total operation to be interrupted at any given time by operation of one master control.

The rate of dispensing of the fluid coating material from orifice (32) to the inlet port (6) of blender (4) can be controlled accurately by utilizing the embodiment shown in partial cross-section in FIG. 2. In this modification a nipple member (46) provided with a single annular passage (48) is interposed between the shutoff valve (40) and the orifice (32). The nipple member (46) serves a dual purpose. Firstly, it acts as a metering device for the fluid coating material being dispensed through conduit (38). The amount of material which passes through the annular passage (48) at any given pressure can be readily determined and a calibration curve derived thereby showing rate of passage of fluid v. pressure. Using the calibration curve so derived, it is possible to adjust rates of flow of fluid material at any time by appropriate adjustment, using pressure regulator (40), of the pressure of fluid material in the conduit (38) preceding the metering device.

The nipple member (46) can be retained in the conduit (38) in any suitable manner In the particular embodiment shown in FIG. 2 the nipple is inserted in the end of main conduit (38) and held in place therein by brazing, soldering or any other suitable means. A second conduit (38*a*) is attached to the end of the main conduit (38) by appropriate means, e.g. by appropriate threads formed on the overlapping portions of the inner surface of the conduit (38*a*) and the outer surface of conduit (38).

The second function which nipple (46) serves is to give rise to a stream of atomized liquid which exits from the orifice (32) in a substantially linear path. This is in contrast to the uncontrolled spray pattern which occurs in the absence of the nipple member in the conduit or the spray pattern which is formed when the orifice (32) is provided with a standard spray nozzle as discussed above.

Figure 3:
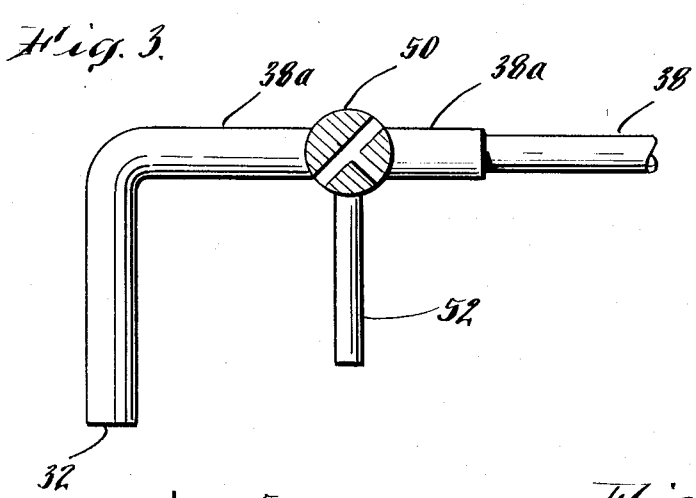
FIG. 3 shows a cross-sectional view of a further modification of the fluid material dispensing orifice shown in FIG. 1.

The calibration of the metering device formed by the use of the nipple (46) as shown in FIG. 2 can be achieved by collecting the appropriate amount of material over a given time which leaves the orifice (32) at a given pressure. However, in order to check the calibration while in actual operation, a 3-way valve (50) is interposed in conduit (38*a*) between the nipple (46) and the orifice (32) and thereby provides a means of sampling the stream of fluid passing through the nipple member (46) through a side arm (52) into a suitable receptacle. This particular arrangement is illustrated in FIG. 3 where the various other numerals identifying elements have the same meaning as in FIGS. 1 and 2.

In a further modification of the apparatus according to the invention the fluid coating material can be prepared in situ by admixing streams of two or more separate components, such as, for example, water and an emulsifiable isocyanate, followed by dispensing of the so produced fluid coating material directly into the blender (2). An embodiment of this modification of the dispensing means for the fluid coating material is illustrated schematically in FIG. 4. Two separate streams of components for production of the fluid coating composition are each fed separately from appropriate storage tanks (54) and (56) via pumps (58) and (60), respectively, pressure regulators (62) and (64), respectively, and stop valves (66) and (68), respectively, to a mixing head (70). In the latter the two components undergo impingement mixing under pressure and the resulting mixture is dispensed through orifice (32') into the inlet port (6) of the blender (4) as shown in FIG. 1. The two stop valves (66) and (68) are operatively connected to each other and to the master control device (45) so that these valves can be actuated or deactuated synchronously with the drive means (30) of the particulate material conveyor and the drive means (18) of the blender agitator shown in FIG. 1.

Figure 5:
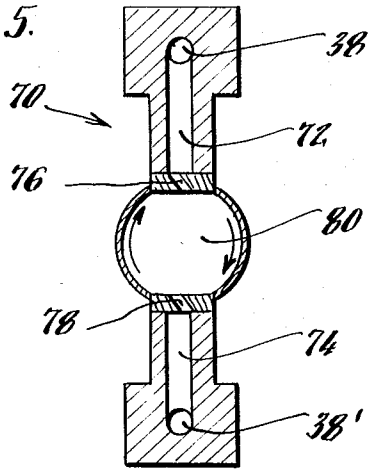
FIG. 5 shows a cross-sectional view taken along the line 5—5 in FIG. 4.
Figure 4:
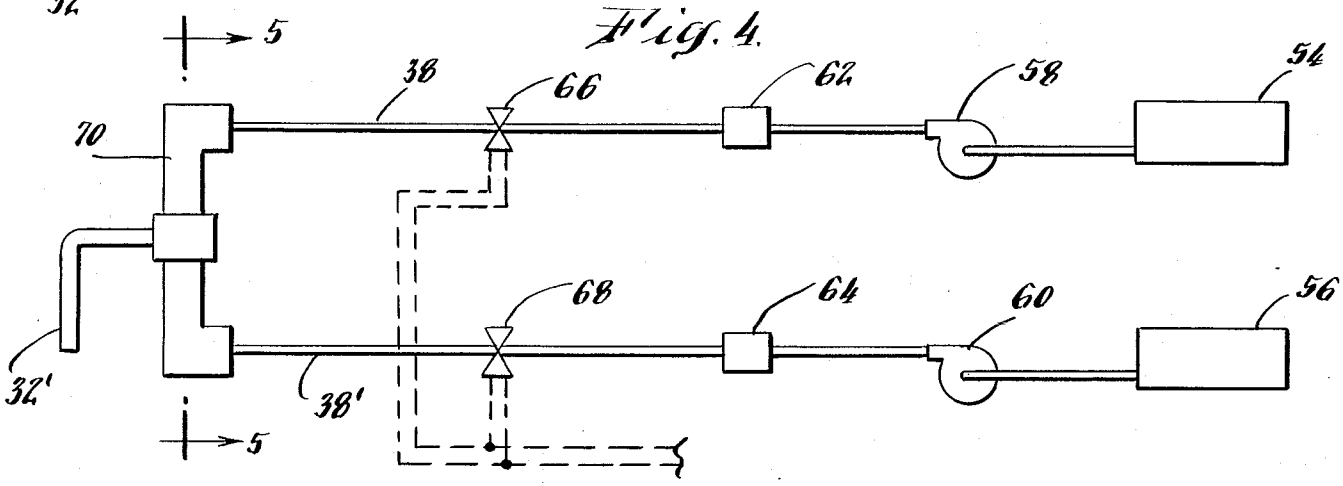
FIG. 4 shows, in schematic form, an alternative embodiment of the fluid material dispensing system shown in FIG. 1.

FIG. 5 shows a cross-sectional view taken through the line 5—5 in FIG. 4 and illustrates the manner in which the two components of the fluid coating material are brought together in the mixing chamber of the mixing head (70). As shown in FIG. 5 the two individual components enter the mixing chamber via the conduits (38) leading into the passageways (72) and (74), respectively, and thence through orifices (76) and (78) into the mixing chamber (80). As will be seen from FIG. 5 the orifices (76) and (78) are disposed at an angle to the longitudinal axis of the passageways (72) and (74), respectively, thereby directing fluid passing therethrough in a peripheral trajectory into mixing chamber (80) as illustrated by the arrows. These streams of fluid so entering the mixing chamber (80) impinge on each other under pressure and are mixed by the turbulence so created before being dispensed through the nozzle (32').

If desired, the conduits (38) and (38') leading into the mixing head (70) shown in FIG. 4 can be provided with nipple members as shown in FIG. 2. Calibration devices as shown in FIG. 3 can also be introduced in the conduits (38) and (38') between the stop valves (66) and (68) and the mixing head. The proportions in which the two components are being dispensed into the mixing head (70) can be readily adjusted through a wide range by appropriate adjustment of the relative rates of flow of the two components. In a particular embodiment one component is formed by water and the second component is a polyisocyanate admixed with appropriate emulsifying agent or agents so that the two components when brought together in the mixing head (70) form an isocyanate emulsion. Where such a combination is used and the components are to be fed in a fixed ratio to the mixing head, it is appropriate to employ as the pumps two piston type pumps in which the lengths of the pistons in the two pumps are different and correspond to the difference in rate of supply of the two components to the mixing head. The two pumps can then be driven from a common source and geared together so that the two components are delivered to the mixing head in any constant preselected ratio.

While the process and apparatus of the invention has been described above in relation to several specific embodiments, it will be appreciated that other modifications can be made that are not essential to the novel combination defined in the appended claims and that such modifications and equivalents are also, therefore, intended to be comprehended by said claims.

We claim:

1. A method for continuously coating wood furnish with fluid binder adhesive which comprises the steps of
   - continuously feeding said wood furnish and fluid binder adhesive separately in predetermined proportions to a blending zone;
   - continuously blending said wood furnish and fluid binder adhesive in said blending zone by means of an agitator with paddles wherein a major proportion of said binder adhesive contacts said wood furnish;
   - continuously conveying the blended materials to a storage zone; and
   - providing master control means for simultaneously discontinuing said feeding of said wood furnish and said fluid binder adhesive and said blending of said materials.

2. A method according to claim 1 wherein said fluid binder adhesive is a binder composition for the preparation of particle board by subsequently subjecting said wood furnish coated with said binder to heat and pressure molding.

3. A method according to claim 1 wherein said binder composition is an organic polyisocyanate.

4. A method according to claim 3 wherein said organic polyisocyanate is employed in the form of an aqueous emulsion.

5. A method according to claim 4 wherein said aqueous emulsion is prepared by turbulent mixing of the organic polyisocyanate, water and emulsifying agent in preselected ratios in a mixing head from which the resulting emulsion is dispensed directly to the blending zone.

6. A method for continuously coating wood furnish with an organic polyisocyanate binder composition prior to subjecting said coated wood furnish to the action of heat and pressure to form particle board, which method comprises the steps of:

continuously feeding wood furnish and an organic polyisocyanate binder separately in predetermined portions to a blending zone;

continuously blending said furnish and said binder in said blending zone by means of an agitator with paddles wherein a major proportion of said binder adhesive contacts said wood furnish;

continuously conveying the blended materials to a storage zone; and providing master control means for simultaneously discontinuing (a) said feeding of said wood furnish and said organic polyisocyanate binder composition, (b) said continuous blending of said materials and (c) the conveyance of said blended materials to said storage zone.

7. A method according to claim 6 wherein said organic polyisocyanate binder composition comprises an aqueous emulsion of an organic polyisocyanate.

8. A method according to claim 7 wherein said aqueous emulsion is prepared by turbulent mixing of the organic polyisocyanate, water and emulsifying agent in preselected ratios in a mixing head from which the resulting emulsion is dispensed directly to the blending zone.

* * * * *